United States Patent [19]

Coates et al.

[11] 4,292,939

[45] Oct. 6, 1981

[54] FAIL SAFE DEVICES FOR USE WITH DEVICES FOR LIMITING THE SPEED OF REVOLUTION OF AN INTERNAL COMBUSTION ENGINE

[75] Inventors: John P. Coates, London, England; David H. Lewis, Swansea, Wales

[73] Assignee: Lumenition Limited, London, England

[21] Appl. No.: 102,907

[22] Filed: Dec. 13, 1979

[51] Int. Cl.[3] ..... F02P 9/00

[52] U.S. Cl. ..... 123/335; 123/320; 123/329; 123/630; 123/359; 123/198 DC; 123/198 D

[58] Field of Search ..... 123/335, 320, 329, 630, 123/359, 198 DC, 198 D

[56] References Cited

U.S. PATENT DOCUMENTS 3,699,935 10/1972 Adler et al. ..... 123/359
4,034,732 7/1977 Van Burkleo ..... 123/630
4,171,687 10/1979 Coventry ..... 123/335
4,186,711 2/1980 Jöerg ..... 123/630
4,193,385 3/1980 Katsumata et al. ..... 123/630

*Primary Examiner*—Charles J. Myhre
*Assistant Examiner*—R. A. Nelli
*Attorney, Agent, or Firm*—Toren, McGeady & Stanger

[57] ABSTRACT

A fail safe device for isolating the revolution limiter from the ignition system of an internal combustion engine, in which the output stage of the revolution limiter is continuously monitored to ascertain whether or not it is absorbing ignition pulses at a speed lower than the limiting speed. In the event that the absorption of ignition pulses is taking place at a speed lower than the limiting speed, the fail safe device becomes operative upon the engine revolutions falling below a given value and causes a fuse in series with the output stage of the revolution limiter to blow, thus isolating the revolution limiter from the ignition system to allow ignition to be instantly re-established in the event of a fault occuring in the revolution limiter.

10 Claims, 1 Drawing Figure

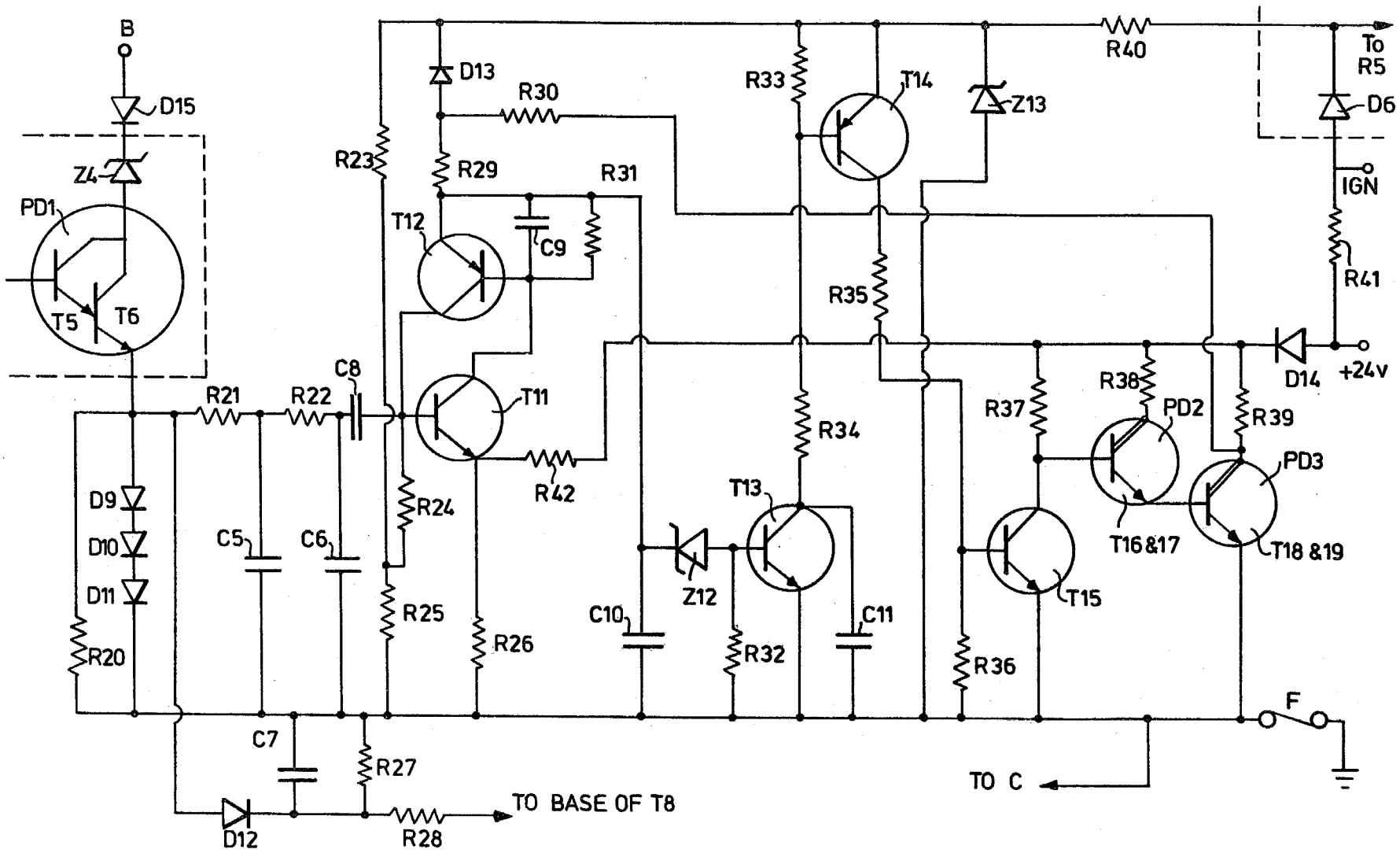
To R5
D6
IGN
R41
+24V
D14
R39
PD3
T18 &19
F
R40
PD2
R38
T16&17
T15
R37
R36
TO C
Z13
T14
R35
R34
C11
R33
T13
R32
Z12
C10
R31
C9
R42
T11
R26
TO BASE OF T8
R30
D13
R29
T12
R24
R25
R28
R27
R23
C8
R22
C6
C7
C5
D12
R21
D15
B
Z4
T6
T5
PD1
D9
D10
D11
R20

FAIL SAFE DEVICES FOR USE WITH DEVICES FOR LIMITING THE SPEED OF REVOLUTION OF AN INTERNAL COMBUSTION ENGINE

FIELD OF THE INVENTION

The present invention relates to fail-safe devices for use with devices for limiting the speed of revolution of an internal combustion engine of the type disclosed in U.S. Patent Application Ser. No. 774,951 which issued as U.S. Pat. No. 4,171,687 on Oct. 23, 1979, to M. Coventry. The disclosure of this issued patent is incorporated herein by reference.

U.S. Patent Application Ser. No. 774,951 discloses a device for limiting the speed of revolution of an internal combustion engine having an ignition coil providing spark ignition and including a primary winding having first and second terminals one of which is connected to a positive supply line and the other of which is remote from the positive supply line, said device comprising: revolution detecting means for detecting the number of revolutions of the engine per unit time; a semiconductor breakdown device which will break down above a given threshold voltage; a semiconductor switch connected in series with said semiconductor device between that terminal of the primary winding of the ignition coil which is remote from the positive supply line and ground; and biasing means responsive to said revolution detecting means for biasing the semiconductor switch so that said switch switches from a first state wherein said switch is alternately conductive and non-conductive to a second state in which the semiconductor switch is biased to be continuously conductive for speeds above a predetermined limit so as to provide limiting of the voltage developed in the primary winding of the ignition coil to a voltage equal to the breakdown voltage of said semiconductor device when the speed exceeds said limit, the non-conductive mode of said switch in said first state providing normal ignition operation at speeds below said limit.

For certain applications, it is extremely important that if the revolution limiting device fails, it should be cut out of the circuit so that its failure should not cause the vehicle to come to a standstill if the device effectively prevents ignition from occurring below the limiting revolution speed. This is particularly of importance in military vehicles and tanks.

SUMMARY OF THE INVENTION

It is therefore an object of the present invention to overcome the above mentioned disadvantage.

According to the present invention there is provided a fail-safe device for isolating the revolution limiter from the ignition system of an internal combustion engine having spark ignition, said fail-safe device including: means for detecting that the output stage of the revolution limiter is absorbing ignition pulses at a speed lower than the predetermined limiting speed; and means for isolating the revolution limiter from the ignition circuit in the event that the absorption takes place at a speed below the limiting speed.

Preferably the "fail-safe" device comprises means for detecting that the output stage of the revolution limiter is absorbing ignition pulses; filter means; electronic switch means operable from the output of the filter means; pulse stretcher means operable from the output of the switch means and further electronic switch means in series with fuse means for blowing the fuse in the event of a fault having been detected in the revolution limiter circuitry.

The fuse means is preferably connected between earth and the earth-line of the revolution limiter circuitry, so that in the event of the fuse being blown, the earth-line is disconnected from the revolution limiter thus rendering it inoperative.

BRIEF DESCRIPTION OF THE DRAWING

The present invention will now be described in greater detail by way of example with reference to the accompanying drawing, wherein the sole FIGURE is a circuit diagram of one preferred form of "fail-safe" device for isolating the revolution limiter from the ignition system of an internal combustion engine having spark ignition in the event of a fault occurring therein.

DESCRIPTION OF THE PREFERRED EMBODIMENT

Referring to the drawing, the "fail-safe" device comprises transistors T11–T19; resistors R20–R42; capacitors C5–C11; diodes D9–D15; zener diodes Z12 and Z13 and a fuse F.

The parts located within the broken lines, namely the power Darlington pair PD1; the zener diode Z4 and the diode D6 correspond to those elements shown in FIG. 3 of U.S. Patent Application Ser. No. 774,951. Also, the terminals B and C likewise correspond to the terminals in FIG. 3 of the above mentioned Patent Application with the exception that in the case of terminal C, the actual earth is removed from the earthline of the circuit shown in FIG. 3 so that the earth-line of the revolution limiter is connected to earth through the fuse F.

The diode D15 is connected between the terminal B and the zener diode Z4 of the revolution circuit shown in FIG. 3 of U.S. Patent Application Ser. No. 774,951. This diode ensures that when the fuse has blown, the battery cannot drive current through the revolution limiter back to the coil which otherwise might cause further damage to the revolution limiter and the fail-safe device.

The emitter electrode of the transmitter T6 of the power Darlington pair PD1 of the revolution limiter is connected to a diode circuit comprising series diodes D9 to D11 in parallel with the resistor R20 and also the input of a filter circuit which is connected across the series diodes D9 to D11. The function of the diodes D9 to D11 is to maintain substantially constant output voltage irrespective of the current flowing through them. The filter circuit comprises capacitors C5 and C6 and resistors R21 and R22. The base electrode of the transistor T11 is connected to the emitter electrode of the transistor T6 of the power Darlington pair PD1 through the resistors R21, R22 and the capacitor C8.

A special circuit for ensuring that the revolution limiter does not blow the fuse as the engine speed approaches the limiting speed, due to the revolution limiter suppressing odd ignition pulses, comprises a diode D12, a capacitor C7 and resistors R27 and R28. The emitter electrode of the transistors T6 of the power Darlington pair PD1 is connected to the base electrode of the transistor T8 in FIG. 3 of U.S. Patent Application Ser. No. 774,951 through the diode D12 and the resistor R28. The capacitor C7 and the resistor R27 are connected in parallel between the junction of the diode D12 and the resistor R28 and the earth-line. The function of the circuit is thus to feed the voltage across the diodes chain D9 to D11 back to the revolution limiter in order to depress the cut-out point by approximately 2%.

The positive supply from a 24 volt battery to the "fail-safe" device is by two routes, the first being through the resistor R41, the diode D6 in the circuit of FIG. 3 of U.S. Patent Application Ser. No. 774,951 and a resistor R40. This first positive supply is stabilized at 5.6 volts by means of the zener diode Z13. The second positive supply is through the diode D14. This second supply principally feeds the two power Darlington pairs PD2 and PD3 respectively consisting of transistors T16, T17, and T18, T19. The two Darlington pairs themselves arranged as a double power transistor stage each having a respective collector resistor R38 and R39, the emitter electrode of the transistor T17 being connected to the base electrode of the transistor T18. The arrangement is such that the power transistor stage consisting of the two Darlington pairs is normally held in the non-conductive state, but when it is switched to the conductive state it can pass sufficient current to blow the fuse F.

The transistor T15 acts as a trigger for the power transistor stage and is normally held in the on state receiving its supply through the resistor R37. The base electrode of the transistor T15 is connected firstly to earth through the resistor R36 and secondly to the collector electrode of a transistor T14 through the resistor R35. The emitter electrode of the transistor T14 is connected to the first stabilized positive supply. The base electrode of the transistor T14 is connected firstly to the stabilized positive supply through the resistor R33 and secondly to the collector electrode of the transistor T13 through the resistor R34. The emitter electrode of the transistor T13 is connected directly to the earth-line and the capacitor C11 is effectively connected across the emitter-collector path of the transistor T13. The base electrode of the transistor T13 is connected to earth firstly through a resistor R32 and secondly through the zener diode Z12 and capacitor C10. The junction between the zener diode Z12 and the capacitor C10 is connected to the emitter electrode of the transistor T12. Across the base-emitter electrodes of the transistor T12 is connected a parallel circuit consisting of the capacitor C9 and the resistor R31. The function of the capacitor C9 is to immunize the transistors T11 and T12 from spurious triggering due to electrical noise. The transistor T12 receives its supply from the second voltage circuit through the resistors R29, R30 and the resistor R39 which is the collector load of the second power Darlington pair PD3. The diode D13 is connected in reverse mode between the junction of the resistors R29 and R30 and the first stabilized supply line and maintains the potential at the junction between the resistors R29 and R30 at approximately 6.3 volts, i.e. 0.7 volts above the stabilized supply. The collector electrode of the transistor T12 is connected to the base electrode of the transistor T11 and the collector electrode of the transistor T11 is connected to the base electrode of the transistor T12. The emitter electrode of the transistor T11 is connected to the 24 volt battery supply through the resistor R42 and the diode D14 and is also connected to the earth-line through the resistor R26. A divider circuit consisting of the resistors R23 and R25 is connected across the first stabilized supply and the junction between these two resistors is connected to the base electrode of the transistor T11 and also to the collector electrode transistor T12 through the resistor R24.

The operation of the above described fail-safe circuit for use with a revolution limiter associated with an internal combustion engine having spark ignition will now be described in greater detail with particular reference to its application to a tank engine whose limit of engine revolutions is 4,750 RPM.

Under normal operating conditions, as previously stated, the power transistor stage consisting of the Darlington pairs PD2 and PD3 is non-conductive. The transistors T14 and T15 are normally on, the bias requirements for the PNP transistor 14 being such that the transistor T13 is also in the conductive state. The capacitor C10 is normally held at a voltage which is equivalent to the breakdown voltage of the zener diode Z12, this voltage being sufficient to hold the transistor T13 in the conductive state. In order to blow the fuse F, the power transistor stage consisting of the Darlingtons PD2 and PD3 must be switched to their conductive state, this being done when the transistor T13 is triggered to its non-conductive state. The triggering of the transistor T13 is effected when the capacitor C10 is discharged through the transistors T11 and T12 and the resistor R26. This can only be done when the transistor T11 is rendered conductive.

Under normal operating conditions below the limit speed of 4,750 RPM, substantially no voltage is present across the diodes D9 to D11, the small current which flows during the periods that the power Darlington pair PD1 is conductive being conducted to earth through the resistor R20.

If due to the presence of a fault in the revolution limiter the power Darlington pair PD1 is rendered continuously conductive below the limiting speed, a voltage is developed across the diode chain D9 to D11, which is applied to the input of the filter. The filter comprising resistors R21 and R22 and capacitors C5 and C6, has a response which gives a high voltage output at low RPM and a low voltage output at the limit speed of 4,750 RPM. The filter is designed so that its output voltage is substantially equal to the voltage which triggers the transistor T11 into the conductive state at an engine speed of approximately 2,500 R.P.M.

Thus, if as a result of a fault in the revolution limiter a voltage is developed across the diode chain D9 to D11 when the engine speed is above 2,500 but below 4,750 R.P.M. the voltage output from the filter as applied to the base electrode of the transistor T11 through the coupling capacitor C8 is insufficient to trigger the transistor T11 into the conductive state with the result that the fail safe device is not actuated and the power transistor stage remains non-conductive.

When, as a result of the ignition pulses having been suppressed, the speed of the engine falls below 2,500 R.P.M., the voltage output from the filter triggers the transistor T11 into the conductive state. The capacitor C10 is instantly discharged through the transistor T12, which is now rendered conductive, and the transistor T11. The voltage at the base electrode of the transistor T13 falls to a low value when the capacitor C10 is discharged and the transistor T13 is rendered non-conductive. The capacitor C11 which had previously been short circuited by the conductive transistor T13 is now charged up to the stabilized voltage across the zener diode Z13 through the resistors R33 and R34. The potential at the base electrode of the transistor T14 rises during the charging up of the capacitor C11, and the transistor T14 is rendered non-conductive after a given time depending on the time constant of the circuit.

Transistor T15 is likewise rendered non-conductive as soon as the transistor T14 has ceased to conduct, and the power transistor stage consisting of the two Darlington pairs PD2 and PD3 is rendered conductive to cause the fuse F to blow. This current passed by the power transistor stage is considerably in excess of the fuse rating of 2 amps and the fuse consequentially blows. This removes the earth from the earth-line of the revolution limiting device and thus renders it inoperative so that the power Darlington pair PD1 is blocked and the ignition system of the vehicle which had been rendered inoperative is enabled again and the vehicle does not come to standstill which it otherwise would if the "fail-safe" device had not come into operation to isolate the faulty revolution limiter from the system.

When the power stage turns on, there is a large voltage drop across the resistor R39, so that the voltage at the junction between the resistors R29 and R30 falls below the normal value of 6.3 volts as determined by the diode D13. Accordingly, this drop in voltage ensures that the transistor T13 is held in the non-conductive state.

In order to ensure that the fail safe device will operate when starting the tank engine, i.e. if a fault develops in the revolution limiter during the period that the tank engine is switched off, the capacitor C10 effectively stretches the length of the pulses from the filter. Thus, when the tank engine is cranked in the condition where the revolution limiter has failed, a series of low frequency pulses will be developed across the diode chain D9 to D11. These pulses have the effect of switching the transistor T11 on and off and likewise the transistor T13 off and on. However, unless the transistor T13 is held in the off state for a period which is sufficient to charge the capacitor C11, the transistor T14 will not be switched off with the result that the fail safe device will not operate and the engine cannot be started.

In order to permit the fail safe device to operate at very low R.P.M., i.e. at engine cranking speeds, the time constant for charging the capacitor C10 through the resistors R39, R30 and R29 is such that the capacitor C10 cannot charge up to the value sufficient to turn on the transistor T13 because it is discharged again by the next pulse switching on the transistor T11.

The above described "fail-safe" device for use with revolution limiters for limiting the speed of an internal combustion engine having spark ignition is particularly desirable for military applications, where disastrous consequences could arise if the revolution limiter failed thus cutting out the ignition system of the armoured vehicle or tank. By using such a "fail-safe" device as described above, the vehicle is not rendered inoperative in the event of a fault developing in the revolution limiter.

What we claim and desire to secure by Letters Patent is:

1. A fail-safe device for isolating an electronic revolution limiter associated with an electronic ignition system for an internal combustion engine including a spark ignition coil, the revolution limiter being of the type having an output stage including a semiconductor breakdown device in series with a semiconductor switch for connection in parallel with an output stage of the electronic ignition system, wherein the semiconductor switch is rendered conductive at engine speeds above a predetermined limiting speed to prevent the generation of ignition pulses by limiting the voltage applied to operate the ignition coil; the fail-safe device comprising detecting means arranged to be coupled to the output stage of the revolution limiter for detecting if the semiconductor switch is conductive such as to prevent the generation of ignition pulses at an engine speed lower than the predetermined limiting speed thus indicating that a fault has developed in the revolution limiter, and for providing a corresponding detecting signal containing pulses at a rate proportional to the engine speed; and interrupt means coupled to said detecting means and arranged to be connected to the revolution limiter for isolating the revolution limiter from the electronic ignition system in accordance with said detecting signal.

2. A fail-safe device according to claim 1, wherein said detecting means for detecting if the output stage of the revolution limiter is preventing the generation of the ignition pulses comprises a chain of diodes connected in series with the output stage of the revolution limiter so that a certain voltage is developed thereacross when the output stage of the revolution limiter prevents the generation of ignition pulses.

3. A fail-safe device according to claim 1 including: a filter connected to said detecting means for providing a switching signal in accordance with the detecting signal; and an electronic switch connected to the output of the filter, said switch having a predetermined threshold voltage value above which said switch will conduct, the filter having a characteristic such that when pulses corresponding to engine speed are contained in the detecting signal as a result of a fault having developed in the revolution limiter, the switching signal at the output from the filter will trigger the electronic switch to a conductive state if the engine speed is less than a given speed, and will allow the electronic switch to remain in a non-conductive state if the engine speed is between said given speed and the predetermined limiting speed.

4. A fail-safe device according to claim 1, wherein the interrupt means for isolating the revolution limiter from the electronic ignition system comprises: a power stage arranged to be triggered from a non-conductive state to a conductive state; a fuse connected in series with the power stage and an earth terminal, an earth line from the revolution limiter being connected to the earth terminal through the fuse; and triggering means for providing a trigger signal to the power stage to bring the power stage into a conductive state to blow the fuse in accordance with the detecting signal from said detecting means.

5. A fail-safe device according to claim 4, wherein said triggering means includes pulse stretching means responsive to each of the pulses contained in the detecting signal for sustaining the trigger signal to the power stage during time intervals between successive pulses.

6. A fail-safe device according to claim 1, including: a filter connected to said detecting means for providing a switching signal in accordance with the detecting signal; an electronic switch connected to the output of the filter, said switch having a predetermined threshold voltage value above which said switch will conduct, the filter having a characteristic such that when pulses corresponding to engine speed are contained in the detecting signal as a result of a fault having developed in the revolution limiter, the switching signal at the output from the filter will trigger the electronic switch into a conductive state if the engine speed is less than a given speed, and will maintain the electronic switch in a non-conductive state if the engine speed is between said given speed and the predetermined limiting speed; and said interrupt means includes a power stage arranged to be triggered from a non-conductive state to a conductive state; a fuse in series with the power stage and an earth terminal; an earth line from the revolution limiter being connected to the earth terminal through the fuse; and triggering means for providing a trigger signal to the power stage to bring the power stage into a conductive state to blow the fuse in accordance with the switching signal at the output of the filter; the triggering means including pulse stretching means responsive to each of the pulses contained in the detecting signal for sustaining the trigger signal to the power stage during time intervals between successive pulses.

7. A fail-safe device according to claim 6, wherein said pulse stretching means comprises: a transistor coupled to the electronic switch and arranged to be brought into a conductive state when the electronic switch is in a non-conductive state; voltage storage means arranged to be charged to hold the transistor conductive, and means for discharging the voltage storage means when said electronic switch is conductive and for charging the voltage storage means at a rate sufficiently slow to prevent the voltage storage means from turning on the transistor before the electronic switch is next operated in response to each successive pulse in the detecting signal at an engine cranking rate, so that said power stage will operate at cranking speeds which are substantially less than the given speed if said detecting means provide the detecting signal containing the successive pulses at the engine cranking rate.

8. A fail-safe device according to claim 6, wherein said power stage comprises two power Darlington pairs.

9. A fail-safe device according to claim 1, including inhibit means connected to said detecting means and arranged to be connected to the revolution limiter for preventing the detecting means from actuating the interrupt means as the engine speed approaches the limiting speed and the detecting means provides a detecting signal containing odd pulses.

10. A fail-safe device according to claim 9, wherein said inhibit means includes means for rectifying the pulses contained in the detecting signal from the detecting means, and means for returning the rectified pulses to the revolution limiter in order to depress the cut-out point by a relatively small percentage.

* * * * *